United States Patent [19]

Kern

[11] 3,935,871

[45] Feb. 3, 1976

[54] COLLAPSIBLE WIG STAND

[75] Inventor: Cecil Kern, North Miami, Fla.

[73] Assignee: Lawrence Peska Associates, Inc., New York, N.Y. ; a part interest

[22] Filed: June 13, 1975

[21] Appl. No.: 586,596

[52] U.S. Cl. ..... 132/54; 223/66

[51] Int. Cl.[2] ..... A41G 5/00

[58] Field of Search ..... 132/54, 9; 40/126; 28/74; 223/25, 54, 66; 206/8

[56] References Cited

UNITED STATES PATENTS 3,447,726 6/1969 George ..... 223/66

*Primary Examiner*—G. E. McNeill

*Attorney, Agent, or Firm*—Eugene V. Mandel

[57] ABSTRACT

A collapsible wig stand comprising in combination an inflatable wig form attached to a collapsible purse-like bag having a drawstring for closing and carrying.

2 Claims, 4 Drawing Figures

COLLAPSIBLE WIG STAND

BACKGROUND OF THE INVENTION

1. Field of the Invention

Collapsible wig stand.

2. Description of the Prior Art

Wigs are ancient in their development.

Wig stands in various forms have been known for many years. Known wig stands have included solid head forms of various materials, and inflatable forms generally of plastic. Some of the head forms have had an integral base. Other head forms have been attached to the base by a rod, and in some cases, directly attached.

Various forms of portable wig stands are known.

SUMMARY OF THE INVENTION

The object of this invention is to provide an improved, readily portable, compact collapsible wig stand.

This wig stand can be made of readily available materials by known manufacturing methods. The low cost of manufacture will create a large market with substantial employment. When the head form is deflated and collapsed into the purse-like drawstring bag, the bag can also be used as a purse for carrying other small objects, including wigs.

The head form can be deviated in various ways including the simulation of facial features. In the collapsed position inside the bag, the head form is protected from damage.

DESCRIPTION OF THE PREFERRED EMBODIMENT

Figure 1:
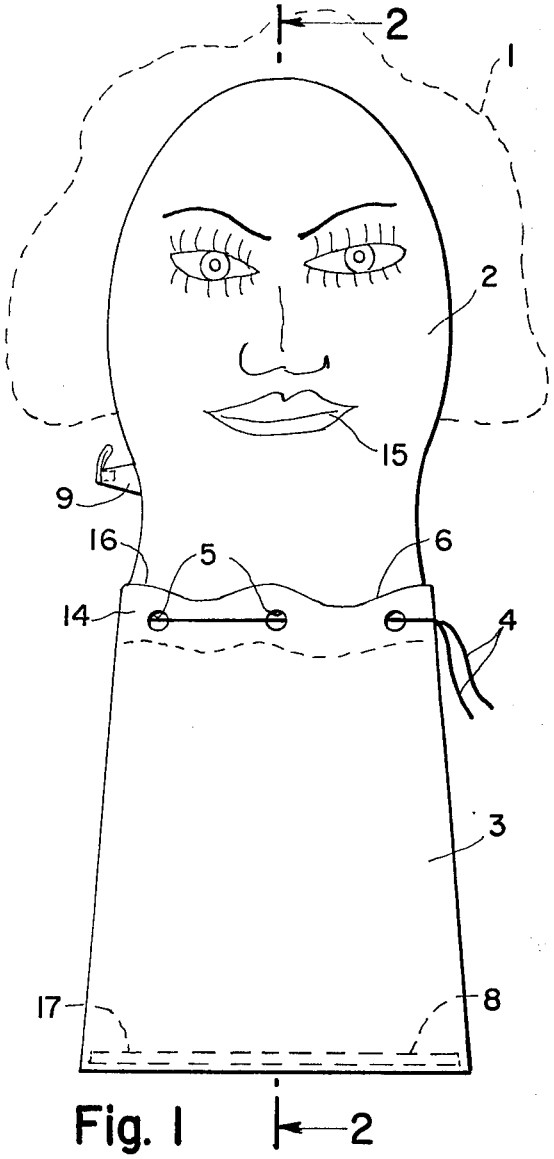
FIG. 1 is a front view of the inflated wig stand.
Figure 2:
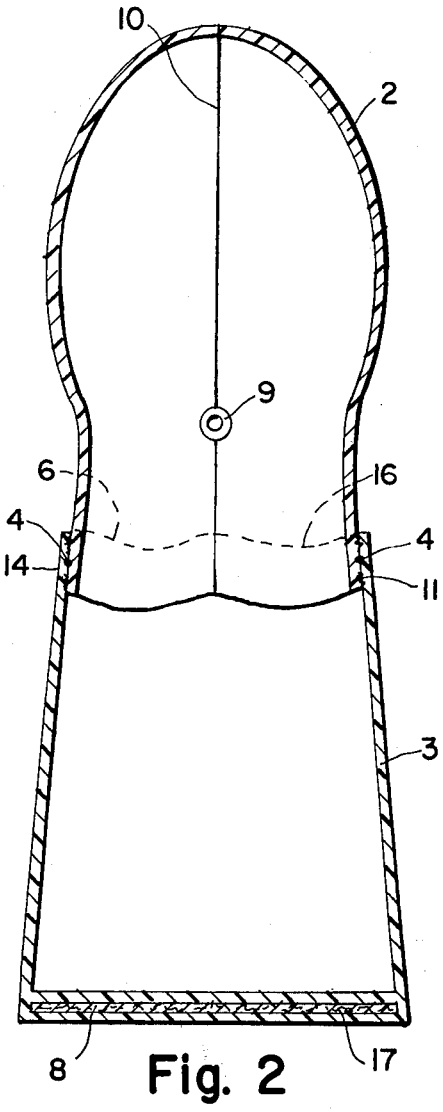
FIG. 2 is a sectional view taken along cutting plane 2—2 in FIG. 1.

A typical embodiment of the invention will now be described. An inflated head form 2 is attached to and mounted upon a bag 3. The size of the neck 14 of the bag 3 can be controlled by the tension in the drawstring 4 which passes thru holes 5 around the neck 14 of the bag 3. The head form 2 can be plain or decorated as at 15 and is used to mount and display a wig 1. The mouth 16 of bag 3 may be straight or may be made with undulating scallops 6. The base of the bag 3 may be of one or more thicknesses and may include a rigid stiffener 8 or weights 17. The head form can be made in various known ways including a seam 10 and can be inflated through sealable opening or mouthpiece 9. The joint 11 between the head form 2 and the bag 3 can be continuous or intermittent.

Figure 3:
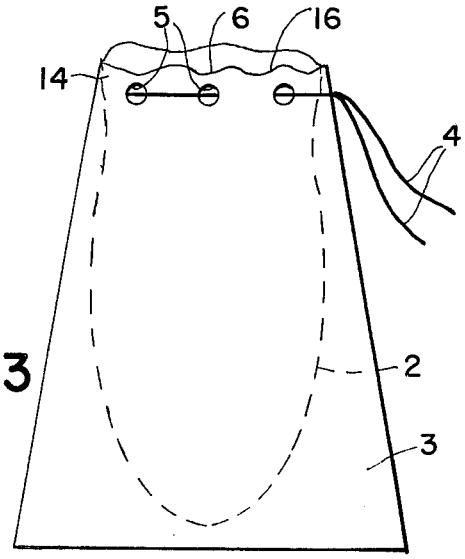
FIG. 3 shows the deflated head form inverted into the bag.

FIG. 3 shows the head form 2 deflated and inverted inside bag 3 permitting the combination to be used as an ordinary drawstring purse to carry suitable items including wigs.

Figure 4:
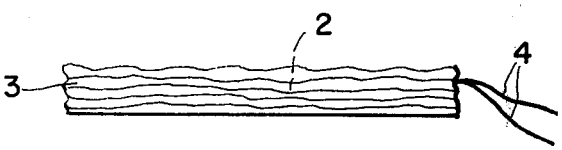
FIG. 4 shows the wig stand collapsed into compact form.

In FIG. 4 the head form 2 inverted into the bag 3 are both shown completely collapsed to occupy minimum volume and to permit ready storage in little space as in luggage or in a small display box.

There are variations which can be accomplished by combining known concepts of the prior art with this basic construction. Of cause, various generally known methods of manufacture and established constructions can be used. It would be prolix to list all possible methods.

It is not intended to be limited to the exact embodiments shown, because the various parts may be changed in size, shape and arrangement without deviating from the spirit of the invention as included in the appended claims.

Having thus described my invention, what I claim as new and desire to secure by Letters Patent is:

1. A collapsible wig stand comprising in combination an inflatable wig form attached to a collapsible purse-like bag having a drawstring for closing and carrying.

2. A collapsible wig stand according to claim 1 in which a weighted base is provided for the collapsible bag.

* * * * *